US006182418B1

(12) United States Patent
McFarland

(10) Patent No.: US 6,182,418 B1
(45) Date of Patent: Feb. 6, 2001

(54) METHOD AND APPARATUS FOR PACKAGING TISSUE IN A POP-UP DISPENSER

(75) Inventor: Timothy Maurice McFarland, Neenah, WI (US)

(73) Assignee: Kimberly-Clark Worldwide, Inc., Neenah, WI (US)

( * ) Notice: Under 35 U.S.C. 154(b), the term of this patent shall be extended for 0 days.

(21) Appl. No.: 09/365,131

(22) Filed: Jul. 30, 1999

Related U.S. Application Data

(60) Continuation-in-part of application No. 08/982,688, filed on Dec. 2, 1997, now abandoned, which is a division of application No. 08/695,485, filed on Aug. 12, 1996, now Pat. No. 5,740,913.

(51) Int. Cl.[7] ..... B65B 5/06; B65B 61/02; B65B 61/04

(52) U.S. Cl. ..... 53/411; 53/429; 53/435; 53/468; 493/411

(58) Field of Search ..... 53/411, 429, 435, 53/458, 117, 131.2, 131.4, 468; 206/494, 824; 493/411, 413, 414

(56) References Cited

U.S. PATENT DOCUMENTS

| | | |
|---|---|---|
| 1,219,239 | 3/1917 | Brown et al. . |
| 1,579,429 | 4/1926 | Arms . |
| 1,797,380 | 3/1931 | Thompson . |
| 1,886,312 | 11/1932 | Stanton . |
| 1,952,382 | 3/1934 | MacGregor . |
| 2,080,729 | 5/1937 | McConnell . |
| 2,085,882 | 7/1937 | Wandel . |
| 2,656,916 | 10/1953 | Henderson . |
| 2,761,676 | 9/1956 | Sabee et al. . |
| 2,761,677 | 9/1956 | Rutkus et al. . |
| 3,119,516 | 1/1964 | Donovan . |
| 3,155,273 | 11/1964 | Cote . |
| 3,207,361 | 9/1965 | Marcalus . |
| 3,224,632 | 12/1965 | Marcalus . |
| 3,819,043 | 6/1974 | Harrison . |
| 3,986,479 | 10/1976 | Bonk . |
| 4,181,225 | 1/1980 | Spiegelberg . |
| 4,200,200 | 4/1980 | Hein, III et al. . |
| 4,231,491 | 11/1980 | Pierson et al. . |
| 4,513,862 | 4/1985 | Mallow . |
| 4,574,952 | 3/1986 | Masui . |
| 4,648,510 | 3/1987 | Kuenzel . |
| 4,824,426 | 4/1989 | DuFresne . |
| 5,149,075 | 9/1992 | Crowley et al. . |

(List continued on next page.)

FOREIGN PATENT DOCUMENTS

| | | |
|---|---|---|
| 253 308 A1 | 1/1988 | (EP) . |
| 365 055 A3 | 4/1990 | (EP) . |
| 2269425 | 11/1975 | (FR) . |

*Primary Examiner*—John Sipos
(74) *Attorney, Agent, or Firm*—Thomas J. Connelly; Patricia A. Charlier

(57) ABSTRACT

A method and apparatus for packaging tissue in a pop-up tissue dispenser is disclosed. The pop-up dispenser being a carton having a top wall, a bottom wall and four sidewalls which join the top wall to the bottom wall. The carton also has an opening formed in the top wall through which the tissues can be withdrawn. The method includes the steps of providing several tissues that are substantially identical to one another. The tissues are described as a first tissue and a plurality of other tissues. The several tissues are transported to a folding station and are interfolded to form an interfolded assemblage. Only the first tissue is colored or has a visual indicator printed or applied to it to form a visually distinctive tissue. The interfolded assemblage is then cut to form a plurality of clips of interfolded tissues. Each of the clips includes one of the visually distinctive tissues and a plurality of the other tissues. The clips are then placed in a carton and oriented such that the visually distinctive tissue is visible through said carton opening. The apparatus includes the mechanism to accomplish the method.

24 Claims, 8 Drawing Sheets

U.S. PATENT DOCUMENTS

| | | |
|---|---|---|
| 5,295,579 | 3/1994 | Focke et al. . |
| 5,332,118 | 7/1994 | Muckenfuhs . |
| 5,368,188 | 11/1994 | Twardowski . |
| 5,520,308 | 5/1996 | Berg, Jr. et al. . |
| 5,531,325 | 7/1996 | Deflander et al. . |
| 5,540,332 | 7/1996 | Kopacz et al. . |
| 5,642,835 | 7/1997 | Young et al. . |
| 5,740,913 | 4/1998 | McFarland . |

METHOD AND APPARATUS FOR PACKAGING TISSUE IN A POP-UP DISPENSER

This application is a continuation-in-part of U.S. Ser. No. 08/982,688 entitled: "POP-UP TISSUE DISPENSER AND METHOD AND APPARATUS RELATING THERETO" filed Dec. 2, 1997, now abandoned and which in turn is a divisional patent application of U.S. Ser. No. 08/695,485 filed Aug. 12, 1996 entitled: "POP-UP TISSUE DISPENSER AND METHOD AND APPARATUS RELATING THERETO" which has issued into U.S. Pat. No. 5,740,913 on Apr. 21, 1998.

FIELD OF THE INVENTION

The present invention relates to a method and an apparatus for packaging tissue in a pop-up dispenser. More particularly, this invention pertains to a method and an apparatus for packaging tissues in a pop-up dispenser such that a visually distinct tissue is visible through the carton opening.

BACKGROUND OF THE INVENTION

Pop-up style dispensers have been used for many years to dispense individual folded sheet products such as facial tissues or the like. In general, pop-up dispensers typically include a container and a stack or clip of prefolded interfolded tissues disposed within the container. The tissues may be C-folded or V-folded so that once the top tissue in the clip is withdrawn, subsequent sheets are individually presented for individual use.

One problem that has persisted through the years concerns the user being able to identify the proper location at which to grasp the top sheet to remove it through the opening in the container. Quite commonly with present commercial tissue containers, the user ends up tearing tissues, separating tissue plies, or dispensing multiple tissues when attempting to remove the top tissue. Furthermore, many commercial tissue dispensers include a plastic film over the opening of the container. Once the top tissue has been raised through a dispensing slit in the plastic film, subsequent tissues are held in an upright position by the plastic film for individual use. If the user has to search with his or her fingers to identify the proper location to grasp the top sheet, the plastic film can become distorted. Particularly with larger size containers, this may result in fall-backs, which refers to subsequent tissues dropping back down into the container rather than staying upright and ready for use.

A number of solutions have been proposed to address the problem of dispensing the top tissue in a pop-up dispenser. For example, it has been recommended that portions of the top sheet can be physically elevated, and thus, more readily identifiable from surrounding portions of the top sheet. It has also been suggested that the top sheet can be bonded to a removable panel of the carton, so that the top sheet is automatically raised through the opening when the panel is removed to form the opening. Other solutions to the problem have suggested adding separate strips within the stack of folded sheets, so that when the separate strips are pulled through the opening of the container, the top sheet is pulled through as well.

The foregoing and other proposed solutions attempting to facilitate proper removal of the top sheet in a pop-up dispenser have either been unsatisfactory or have created new problems. Most notably, past attempts to address the issue have increased the difficulty and/or expense of manufacturing pop-up dispensers, such as by adding new elements within the stack. Moreover, these past attempts to facilitate proper removal of the top tissue have not assisted the user in visually identifying the proper location at which to grasp the top sheet.

Therefore, what is lacking and needed in the art is an improved method and apparatus for dispensing tissue from a pop-up dispenser that facilitates identification and removal of the top tissue without wasting tissue.

SUMMARY OF THE INVENTION

In response to the discussed deficiencies in the prior art, a method and an apparatus for dispensing tissue from a pop-up tissue dispenser have been invented. The method and apparatus improves the ease at which tissue products are dispensed from a pop-up carton.

In one embodiment, a pop-up tissue dispenser includes a carton and a clip of tissues disposed within the carton. The carton has a plurality of walls that define a carton opening through which the tissues may be removed from the carton. The clip includes a visually distinctive tissue and a plurality of other tissues. The visually distinctive tissue and the other tissues are substantially identical except that the visually distinctive tissue includes a visual indicator. The visually distinctive tissue is oriented within the carton such that the visual indicator is visible through the carton opening prior to removal of any tissues from the carton.

This embodiment allows correct dispensing of tissues from the carton by providing visual identification of the best location for the user to grasp the first tissue in the carton. As a result, the user is able to easily dispense the top sheet and initiate the pop-up feature for the underlying sheets. This aspect saves the user from having to waste time examining the clip to determine a good place to initiate removal, and the improved dispensing eliminates wasting sheets on first dispensing. Also, the first tissue comes out easily without being tom and without distorting the plastic film covering the carton opening, if present.

The clip of tissues may be interfolded, prefolded interfolded, or non-interfolded. As used herein, the phrase "prefolded interfolded" tissues means that the tissues are folded and interleaved with neighboring tissues immediately above and/or below in the clip of tissues. The tissues can be interleaved by any suitable means, including the use of an interfolder as is well known in the papermaking arts. If an interfolder is used, consecutive tissues will be attached to each other at perforation lines. In such cases the unperforated segments of the perforation lines should be sufficiently weak to permit the consecutive tissues to separate from each other upon removal from the carton. This can be controlled by the degree of perforation of the tissue sheet. Tissues in a non-interfolded clip are not interleaved with neighboring tissues but are releasably attached to neighboring tissues so that upon dispensing one tissue, the next adjacent tissue is then ready for dispensing. Suitable means for releasably attaching neighboring tissues in a non-interfolded clip include adhesives, mechanical engagement, ultrasonic bonds, thermal bonds, lap seals, fin seals, or the like, as is known in the art.

The term "visual indicator" is used herein to mean a continuous or intermittent pattern disposed directly on and/or in a tissue to visually identify for the user the best location to grasp a tissue to initiate dispensing. The pattern may consist of designs or symbols, such as alphanumeric characters, that are visually distinguishable by the human eye from surrounding regions of the tissue. The pattern is desirably formed of a color that stands out from the surrounding portions of the tissue and is clearly identifiable through any plastic film covering the opening to the container.

Other than the presence of the visual indicator on the visually distinctive tissue, the visually distinctive tissue and the other tissues are desirably substantially identical in all other material respects. Thus, the visually distinctive and other tissues are formed of essentially the same material and have the same basis weight, size and other visual properties as one another. Further, each of the other tissues is desirably substantially visually uniform, which as used herein means that any particular region of one of the other tissues is macroscopically indistinguishable from any other region of that tissue, and in particular that the other tissues are all of the same color. Point bonding between plies of tissue, fold lines, or the like, typically do not provide color differentiation to characterize a tissue as substantially visually non-uniform.

In another embodiment, a pop-up tissue dispenser includes a clip of interfolded tissues disposed within a carton. The clip includes a visually distinctive tissue and a plurality of other tissues. The visually distinctive tissue has primary and secondary folds and includes a visual indicator disposed adjacent the secondary fold. The other tissues have a primary fold and are substantially visually uniform. The visually distinctive tissue is oriented within the carton such that the visual indicator is visible through the carton opening prior to removal of any tissues from the carton.

In particular embodiments, the visual indicator is located less than about 2 centimeters, and more particularly less than about 1 centimeter, from the secondary fold, for improved performance. In other embodiments, the visual indicator has a length dimension greater than a width dimension, and the length dimension is oriented parallel to the secondary fold. The proximity and orientation of the visual indicator relative to the secondary fold facilitates identification of the proper location at which to grasp the top tissue.

In another embodiment, a pop-up tissue dispenser includes a clip of tissues disposed within a carton, and the clip includes a visually distinctive tissue and a plurality of substantially visually uniform other tissues. The visually distinctive tissue and the other tissues are substantially identical except that the visually distinctive tissue is a different color than the other tissues. The tissues are oriented within the carton such that the visually distinctive tissue and at least one of the other tissues are visible through the carton opening prior to removal of any tissues from the carton.

This embodiment utilizes a visually distinctive tissue that is a different color from the other tissues to facilitate correct dispensing of the first tissue from the carton. The visually distinctive tissue and one of the other tissues having a different color are both visible through the carton opening. The color interface that is formed on the user-facing surface of the clip indicates the best location for the user to grasp the first tissue in the carton. The term "different color" is used herein to refer to tissues that appear dissimilar to a user viewing the tissues through the carton opening, based on differing qualities of light reflected by the tissues.

Also in response to the above-noted deficiencies in the prior art, a new method of packaging tissues has been developed. The method includes the steps of: providing several tissue webs that are substantially identical to one another, the several tissue webs including a first tissue web and a plurality of other tissue webs; transporting the several tissue webs to a folding station; interfolding the several tissue webs at the folding station to form an interfolded assemblage of the first tissue web and the other tissue webs; printing a visual indicator on the first tissue web; cutting the interfolded assemblage to form a plurality of clips of interfolded tissues, each of the clips including a visually distinctive tissue having the visual indicator printed thereon and a plurality of other tissues that are substantially visually uniform; providing cartons for the clips, each carton including a plurality of walls that define therein a carton opening; and placing each clip in a carton and orienting the visually distinctive tissue such that the visual indicator is visible through the carton opening.

Further in response to the deficiencies in the prior art, a new apparatus for packaging tissues has been developed. The apparatus includes a web supply system adapted to provide several tissue webs that are substantially identical to one another. These several tissue webs include a first tissue web and a plurality of other tissue webs. A transport system is adapted to transport the several tissue webs to a folding station, where a folding device is adapted to interfold the several tissue webs to form an interfolded assemblage of the first tissue web and the other tissue webs. A printing device of the apparatus is adapted to print a visual indicator on the first tissue web. The apparatus also includes a cutting device adapted to cut the interfolded assemblage into a plurality of clips of interfolded tissues. Each of the clips includes a visually distinctive tissue having the visual indicator printed thereon and a plurality of other tissues that are substantially visually uniform. A packaging system of the apparatus is adapted to place each of the clips in a carton. Each carton includes a plurality of walls that define therein a carton opening, and the visually distinctive tissue is oriented within the carton such that the visual indicator is visible through the carton opening.

The disclosed method and apparatus provide an economical means to manufacture a pop-up tissue dispenser that provides convenient dispensing of the first tissue without waste. The visual indicator can be printed on the first tissue web either before or after formation of the interfolded assemblage. Thus, the printing operation can be continuously operated rather than having to discretely print on each clip.

Numerous features and advantages of the present invention will appear from the following description. In the description, reference is made to the accompanying drawings that illustrate preferred embodiments of the invention. Such embodiments do not represent the full scope of the invention. Reference should therefore be made to the claims herein for interpreting the full scope of the invention.

DETAILED DESCRIPTION OF THE PREFERRED EMBODIMENTS

Figure 1:
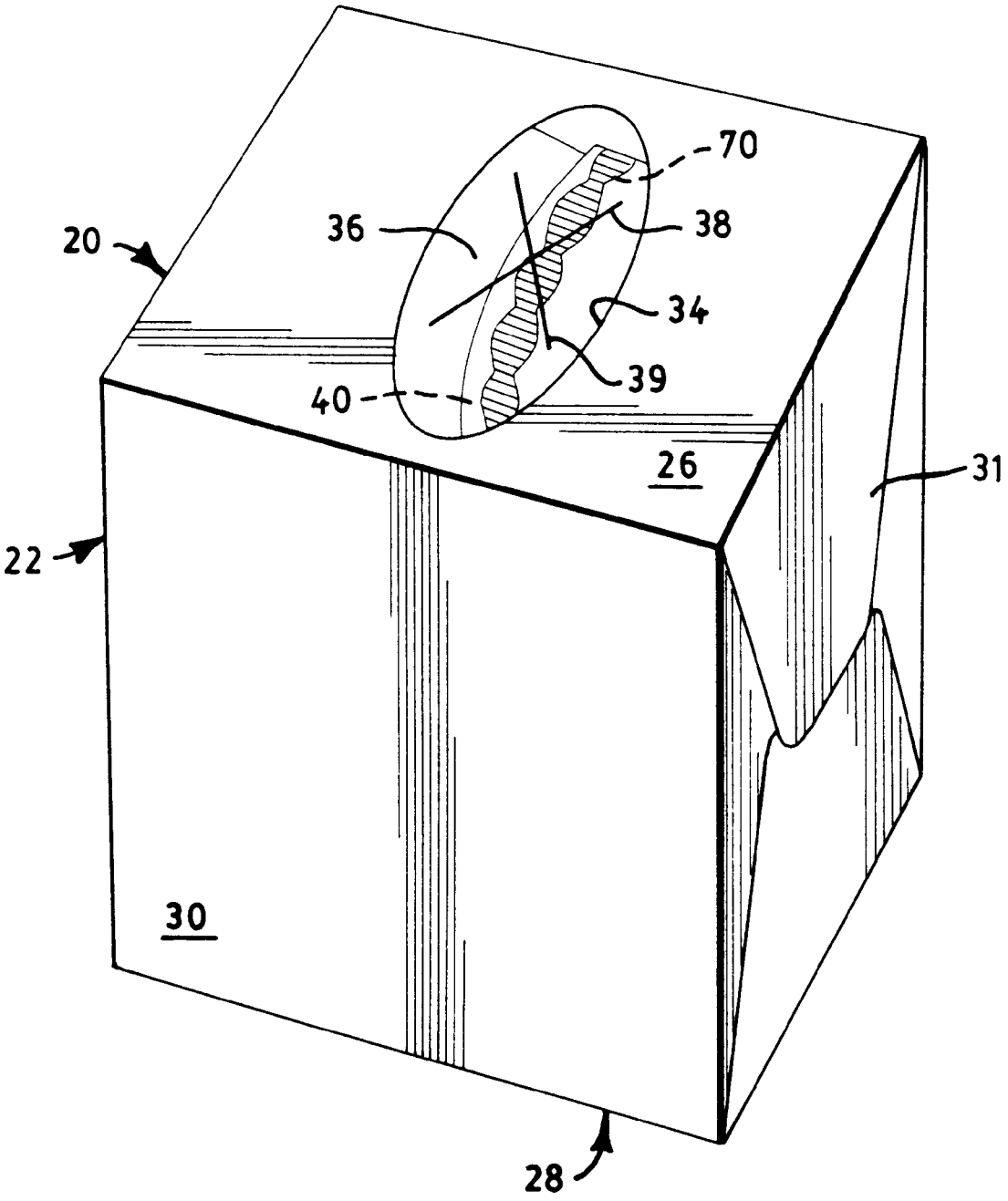
FIG. 1 representatively shows a perspective view of a carton of prefolded interfolded tissues illustrating one embodiment of the present invention.

With reference to FIG. 1, a pop-up tissue dispenser formed according to one embodiment of the present invention is shown for purposes of illustration as an upright, pop-up facial tissue dispenser 20. The invention may also be utilized to dispense other types of folded sheet products. Thus, the term "tissue" is not intended to be limited to facial tissues, but is used herein to include any individual sheet product, such as dry or moistened wipes, for example household or industrial wipes, soap or fabric softening sheets, or the like.

The tissue dispenser 20 includes a carton 22 and a clip 24 (FIG. 2) of prefolded interfolded tissues disposed within the carton. The carton 22 is illustrated as a rectangular parallelepiped comprising a top wall 26, and opposite bottom wall 28, and four sidewalls extending between the top and bottom walls. The sidewalls that are fully visible in FIG. 1 have been given reference numerals 30 and 31. The carton 22 may be constructed in a variety of sizes and shapes as are well known in the art from materials such as paperboard, plastic, or the like. For example, in an alternative embodiment the carton includes a single cylindrical-shaped sidewall extending between the top and bottom walls (not shown). Further, as illustrated in FIG. 1, any of the sidewalls such as sidewall 31 may be constructed of one or more panels that are bonded together by adhesives, thermal bonds, or other suitable means.

The top wall 26 of the carton 22 defines a carton opening 34 in the form of an aperture through which tissues may be individually removed from the carton. The carton 22 optionally includes a plastic film 36 overlaying the carton opening 34 and incorporating intersecting dispensing slits 38 and 39. The use of the plastic film 36 is desirable, particularly for larger carton openings, in order to protect the tissues within the carton and provide sufficient resistance to prevent multiple tissue dispensing. The plastic film 36 may be bonded to the top wall 26 by adhesives or other suitable means, and the dispensing slits 38 and 39 may assume other forms such as a single slit, an aperture or the like. The carton 22 may optionally be provided with a removable panel (not shown) that creates the carton opening when the panel is removed.

Figure 2:
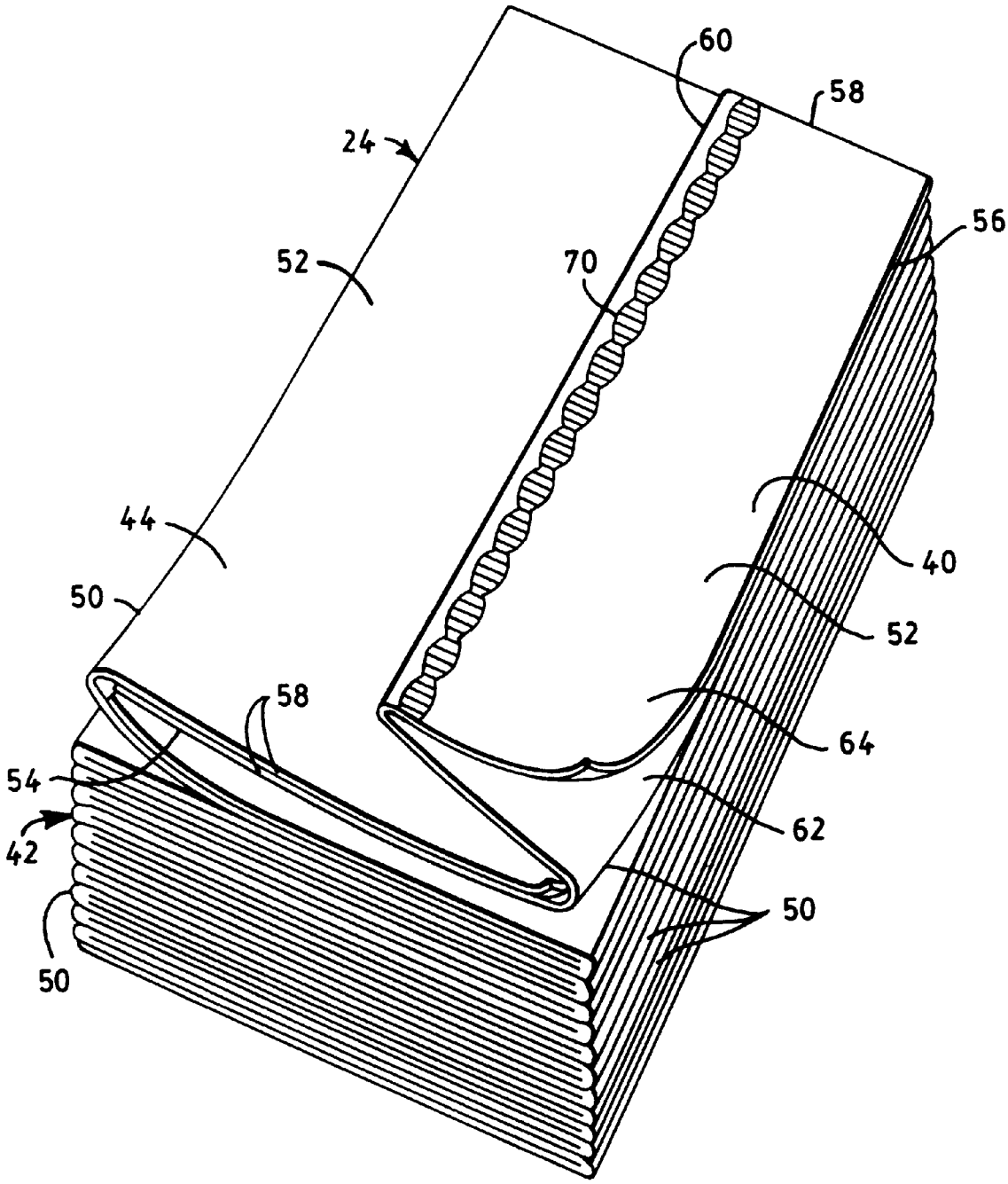
FIG. 2 representatively shows an enlarged perspective view of a clip of prefolded interfolded tissues such as those which could be longitudinally folded and placed in the carton shown in FIG. 1, with the first and second tissues in the clip slightly folded back to more clearly illustrate individual tissues.

An individual clip 24 of prefolded interfolded tissues is illustrated in FIG. 2. The clip 24 comprises a series of tissues beginning with a first tissue referred to herein as a visually distinctive tissue 40 and also including a plurality of other, underlying tissues 42. The underlying tissue 42 that is interfolded with the visually distinctive tissue 40 is referred to herein as a second tissue and has been given reference numeral 44. The visually distinctive tissue 40 and the second tissue 44 are partially raised with a corner turned back in FIG. 2 to better illustrate interfolding of the tissues.

Each of the visually distinctive and underlying tissues 40 and 42 has a primary fold 50 that divides the tissue into upper and lower halves 52 and 54. All of the tissues 40 and 42 include opposite longitudinal side edges 56 and opposite transverse end edges 58 that extend between the side edges. The primary fold 50, in the illustrated embodiment, is formed generally parallel to and intermediate the longitudinal side edges 56.

The visually distinctive tissue 40, unlike the underlying tissues 42, also includes a secondary fold 60 formed in the upper half 52 of the tissue generally parallel to the primary fold 50. The secondary fold 60 divides the upper half 52 of the visually distinctive tissue 40 into an inner segment 62 disposed between the primary and secondary folds 50 and 60 and an outer segment 64 disposed between the secondary fold 60 and a longitudinal side edge 56.

Each of the visually distinctive and the other underlying tissues 40 and 42 are substantially identical in terms of material formation except that a visual indicator 70 is disposed only on the visually distinctive tissue. The visual indicator 70, illustrated in FIG. 2, includes a continuous, colored graphic design of alternating wide and narrow portions. The visual indicator 70 has a length dimension that is greater than a width dimension. The length dimension of the visual indicator 70 is oriented parallel to the secondary fold 60 and extends between the transverse end edges 58 of the visually distinctive tissue 40.

The visual indicator 70 is desirably located on the outer segment 64 of the upper half 52 less than about 2 centimeters (cm.) from the secondary fold 60. In particular embodiments, the visual indicator 70 is located less than about 1 cm. from the secondary fold 60 for improved performance.

The visual indicator 70 may be established on and/or in the visually distinctive tissue 40 by any suitable means such as rotogravure printing, non-contact printing, or other suitable means. The printing may utilize inks, dyes, adhesives, waxes, or the like.

The clip 24 and the visually distinctive tissue 40 are oriented within the carton 22 such that the visual indicator 70 is disposed adjacent the carton opening 34 and visible therethrough, prior to the removal of any tissues. If a plastic film overlays the carton opening 34, the plastic film desirably includes a transparent material so that the visual indicator 70 is visible through the plastic film.

Figure 3:
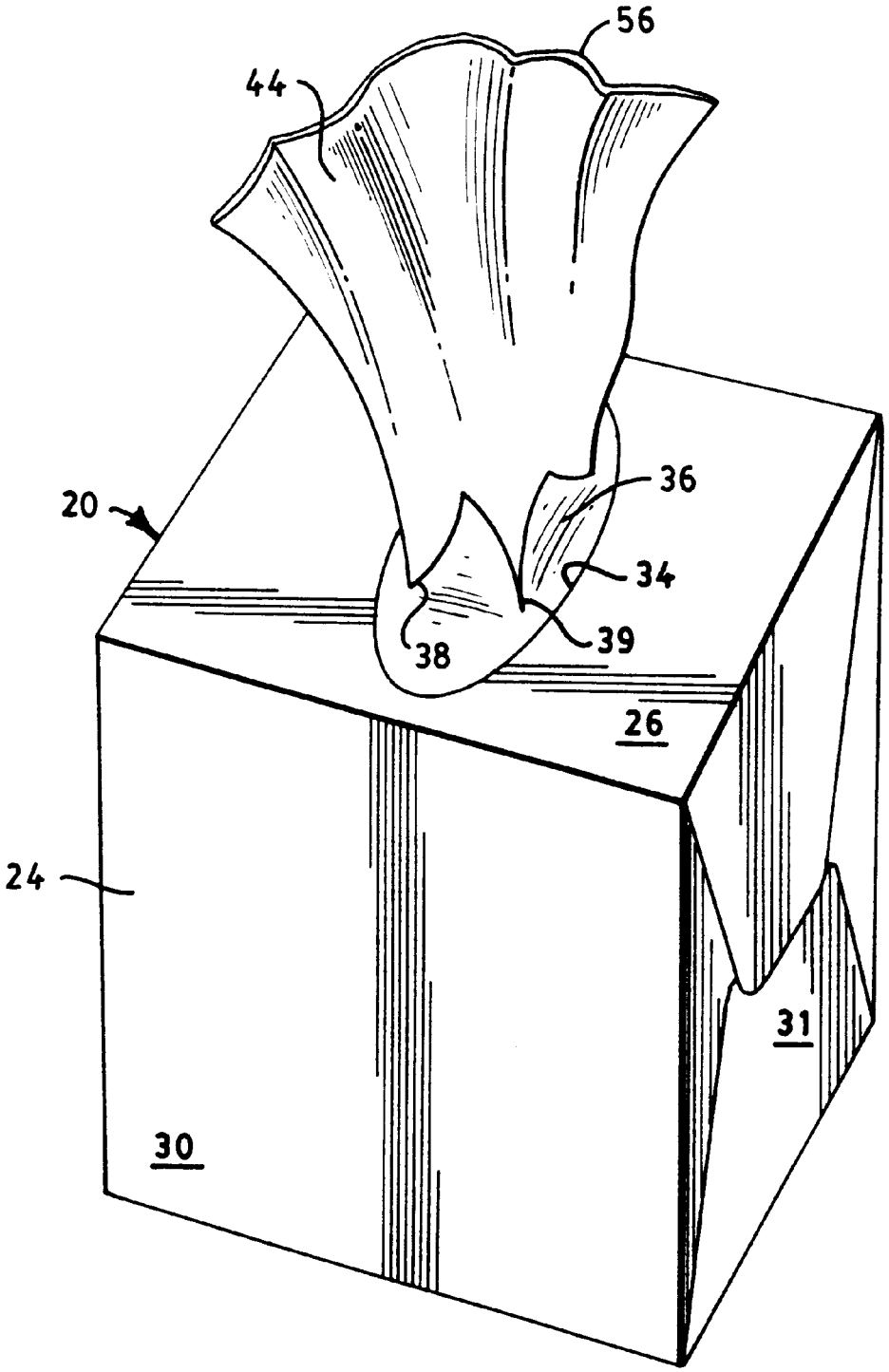
FIG. 3 representatively shows the carton of FIG. 1, with the first tissue having been removed from the carton.

In use, the user can locate the proper location at which to grasp the visually distinctive tissue 40 for removal by observing the location of the visual indicator 70. The user is guided by the visual indicator 70 to grasp the proximately positioned secondary fold 60 to remove the visually distinctive tissue 40 from the carton 22. As the visually distinctive tissue 40 is removed, the second tissue 44 is pulled through the dispensing slits 38 and 39 as a result of interfolding of the visually distinctive tissue 40 and second tissue 44. This pop-up dispensing feature is illustrated in FIG. 3 where the second tissue 44 is shown as being positioned for use and held in place by the plastic film 36. It will be appreciated as well by those skilled in the art that the top dispensing fold configuration could include two, three or more tissue instead of just one as illustrated. Alternatively, the tissues can be non-interfolded and releasably attached to one another sufficiently to enable pop-up dispensing.

Significantly, the other, underlying tissues 42 do not include the visual indicator 70, and as a result, they are considered to be substantially visually uniform. Thus, except for the composition of the visual indicator 70 on the visually distinctive tissue 40, the visually distinctive and underlying tissues, 40 and 42 respectively, can beneficially consist essentially of the same materials in essentially the same configuration. The composition of the tissues will depend upon their intended function, as is well known to those skilled in the art.

The following example is provided to give a more detailed understanding of the invention. The particular amount, proportions, compositions, and parameters are meant to be exemplary, and are not intended to specifically limit the scope of the invention.

A number of pop-up tissue dispensers were constructed including a flat-style carton with a clip 24 of prefolded interfolded tissues disposed within the carton 22. A top wall 26 of the carton 22 defined a carton opening 34 that was overlaid with a plastic film 36 having a dispensing slit 38 and/or 39 formed therein. The top tissue 40 of the clip 24 had primary and secondary folds, 50 and 60 respectively, with the top tissue 40 oriented within the carton 22 such that the secondary fold 60 was positioned beneath the carton opening 34.

All of the tissues were generally uniformly white in color and substantially identical except for a visual indicator 70 that was printed on the top tissue 40 adjacent the secondary fold 60. The visual indicator 70 included a continuous band of repeating text reading "KLEENEX Leading Edge." The term "Kleenex" is a registered trademark of Kimberly-Clark Corporation, Neenah, Wis. The visual indicator 70 was printed on the top tissue 40 using an ink-jet non-contact printing system with light blue ink in 12-point type size. The visual indicator 70 was longitudinally oriented parallel to the secondary fold 60 and spaced within about 0.2 cm. of the secondary fold 60.

Figure 4:
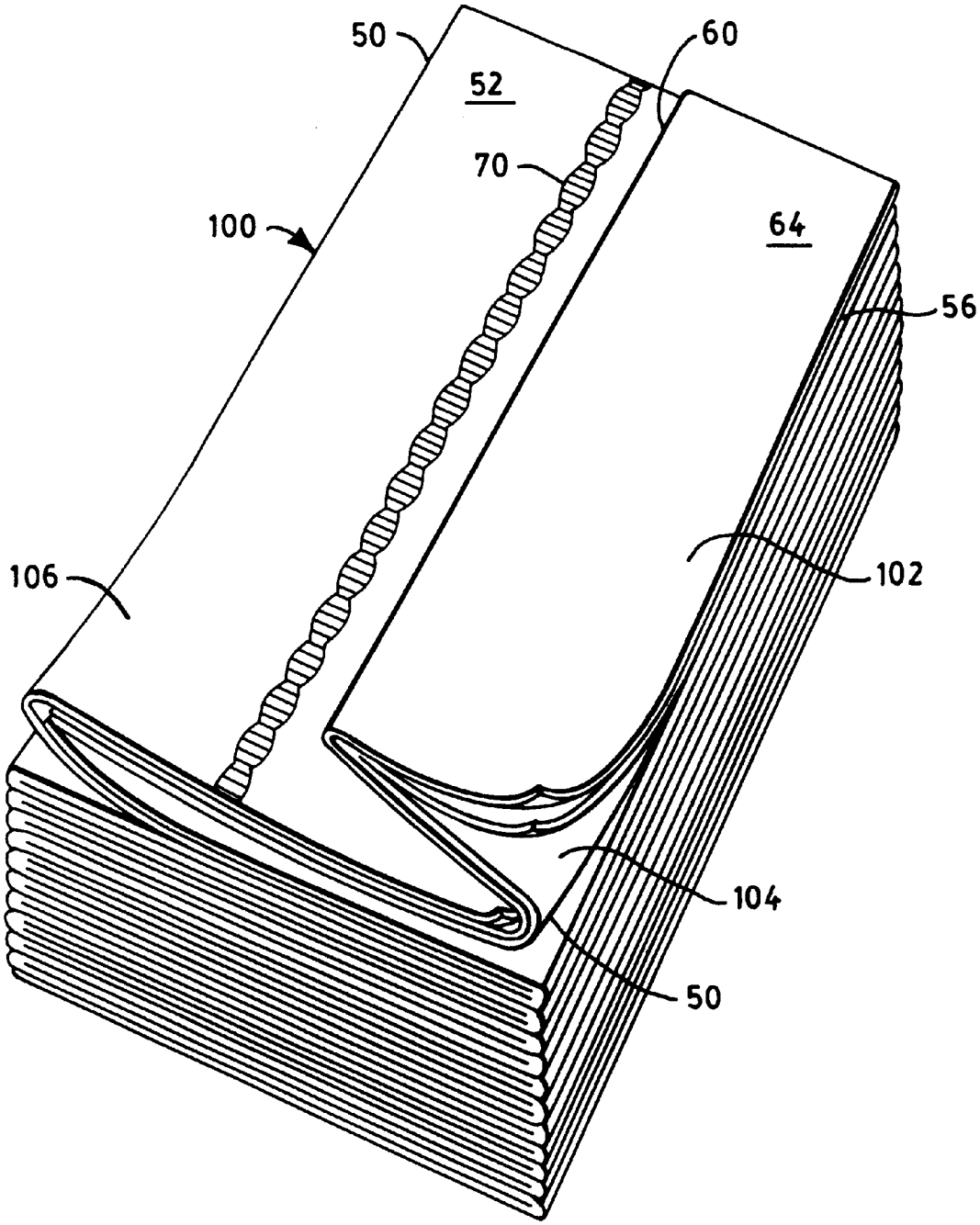
FIG. 4 representatively shows an alternative clip of prefolded interfolded tissues, with the first, second and third tissues in the clip folded back to more dearly illustrate individual tissues.

Various alternative embodiments are possible where the visual indicator 70 is not disposed on the first tissue 40 in the clip 24. One such embodiment is illustrated in FIG. 4, wherein a clip 100 of prefolded interfolded tissues includes a first tissue 102 and a second tissue 104 in a so-called "double pop" arrangement. As used herein, the term "double pop" refers to the first two tissues of a clip being folded together in a common manner such that both tissues 102 and 104 are removed from the carton 22 at the same time to initiate dispensing of tissues from the carton 22. A third tissue in the clip 100 includes a visual indicator 70 and will therefore be referred to as the visually distinctive tissue 106. Desirably, the visually distinctive tissue 106 is located within the first 3 tissues of the first tissue 102.

The first and second tissues, 102 and 104 respectively, include primary and secondary folds 50 and 60. The upper half 52 of the visually distinctive tissue 106 is disposed between the upper and lower halves 52 and 54 of the first and second tissues, 102 and 104. The visual indicator 70 is desirably located adjacent the secondary fold 60 of the first and second tissues, 102 and 104. In particular, the visual indicator 70 is desirably located within about 2 centimeters, and more particularly within about 1 centimeter, of the secondary fold 60 of the first and second tissues 102 and 104. Thus, the visual indicator 70 is not covered by the upper half 52 of the first and second tissues, 102 and 104, and will be visible to the user through the carton opening 34 when the clip 100 is positioned in the carton 22. Despite the visually distinctive tissue 106 not being included in the top dispensing fold configuration, the close proximity of the visual indicator 70 to the secondary fold 60 of the first and second tissues, 102 and 104, provides the necessary indication to the user of the proper location to grasp the folded edge on the user-facing surface of the clip 100.

Figure 5:
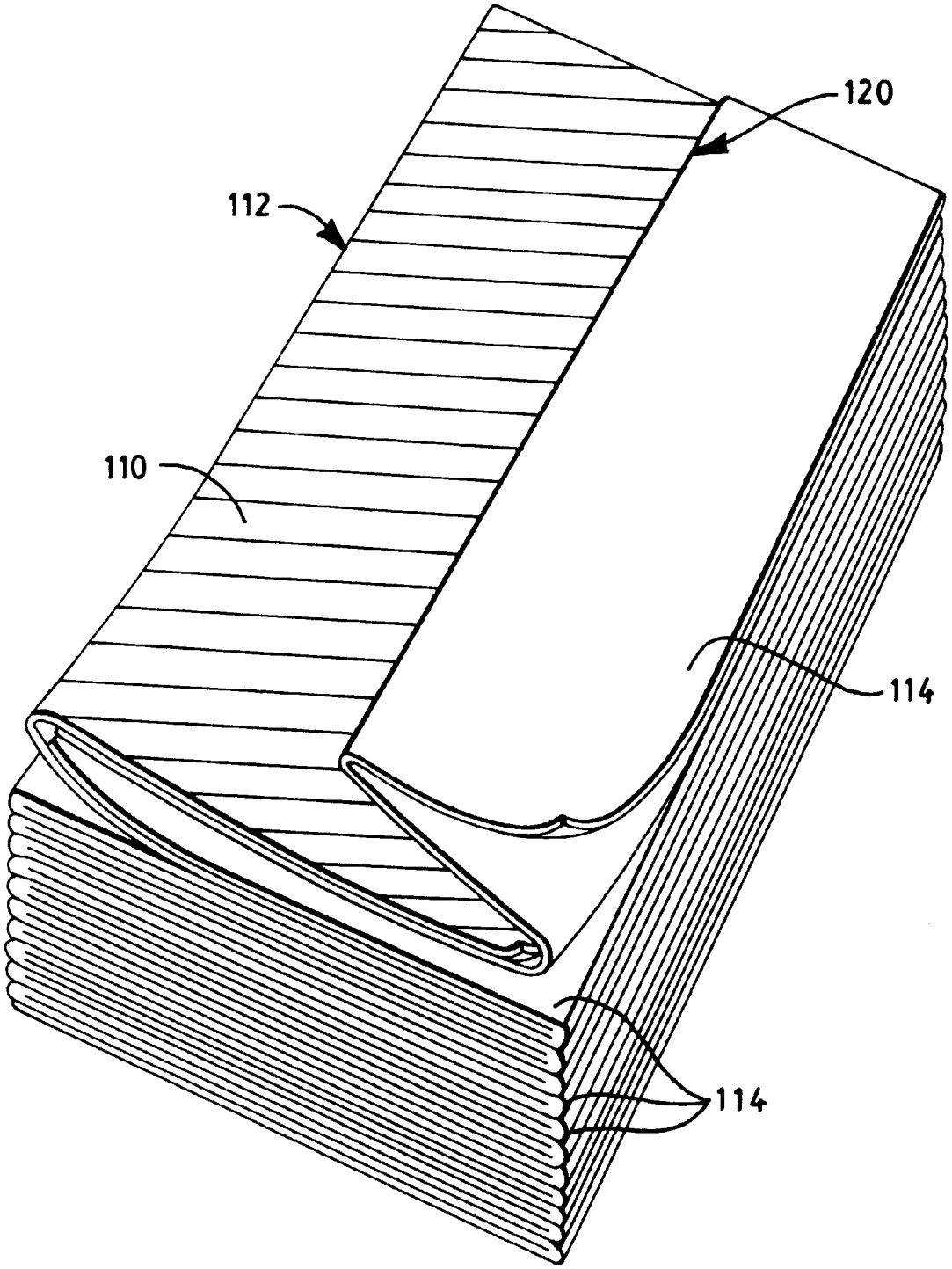
FIG. 5 representatively shows a further alternative clip of prefolded interfolded tissues, with the first and second tissues in the clip slightly folded back to more clearly illustrate individual tissues.

As illustrated in FIG. 5, a visually distinctive tissue 110 may also be obtained by incorporating a tissue that is of a different color than the other tissues. More specifically, a clip 112 of prefolded interfolded tissues includes a visually distinctive tissue 110 and a plurality of substantially visually uniform other tissues 114. The visually distinct tissue 110 and the other tissues 114 are desirably substantially identical except that the visually distinctive tissue 110 is a different color than the other tissues 114. For example, the visually distinctive tissue 110 may be blue and the other tissues 114 may all be white. In the illustrated embodiment, the visually distinctive tissue 110 is the second tissue in the clip 112, although Its position may be altered as discussed above in relation to the visually distinctive tissues of the previous embodiments.

The clip 112 is oriented within a carton 22 so that the visually distinctive tissue 110 and at least one of the other tissues 114 form part of the user-facing surface of the clip 112 and are visible through the carton opening 34 prior to removal of any tissues from the carton 22. The different color of the visually distinctive tissue 110 and the other tissues 114 creates a color interface 120 that identifies for the user the best location to grasp the first tissue 110 in the carton 22.

Method and Apparatus

Figure 6:
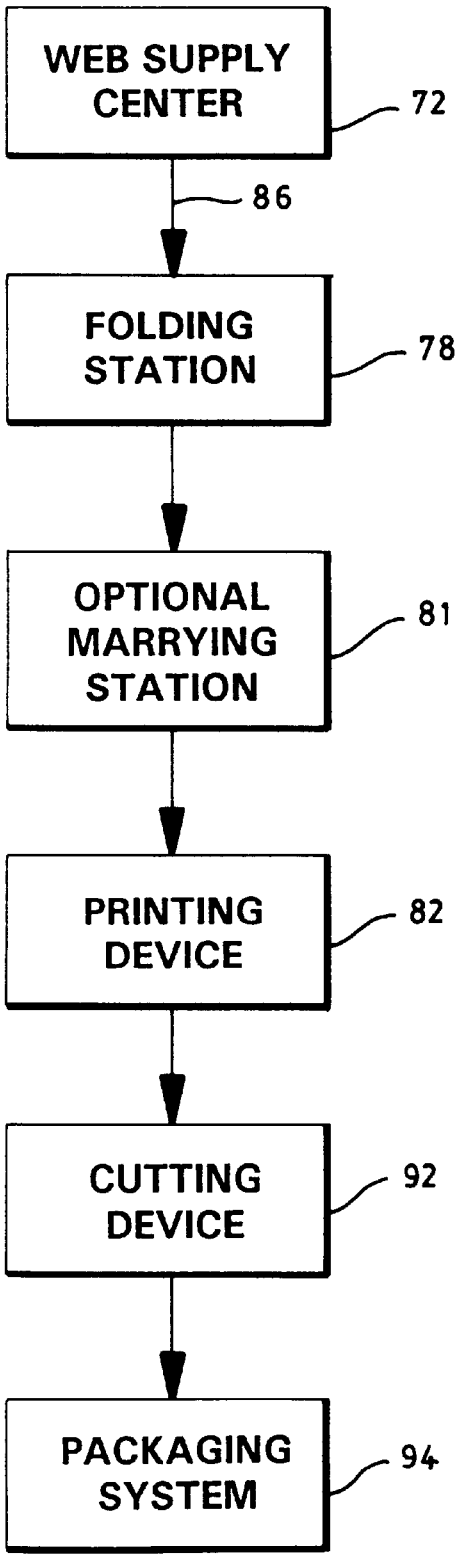
FIG. 6 representatively shows a schematic illustration of a method and apparatus for manufacturing cartons of the type illustrated in FIG. 1.

A particularly desirable method and apparatus for packaging tissues in a pop-up dispenser 20 is schematically illustrated in FIG. 6. The dispenser 20 is in the form of a carton 22 having a top wall 26, a bottom wall 28 and four sidewalls (30 and 31 being shown) joining the top wall 26 to the bottom wall 28. The top wall 26 of the carton 22 also has an opening 34 formed therein through which the tissue 40 and 42 can be withdrawn.

The method includes a web supply system 72 which is adapted to provide several tissue webs 74 (FIG. 7) that are substantially identical to one another. By "identical" it is meant that the tissues have approximately the same size, dimensions, basis weight, etc. The web supply system 72 may include, for example, a plurality of unwinds for dispensing roll product. The tissue webs 74 include a first tissue web 75 (FIG. 7) and a plurality of other tissue webs that are transported by a transport system 76 (FIG. 7) from the web supply system 72 to a folding station 78. The transport system 76 may include a plurality of conveyors, vacuum belts, or the like.

The tissue webs 74 converge at the folding station 78, where a folding device is adapted to prefold and interfold the tissue webs 74 into an interfolded assemblage 80 (FIG. 7) of the first tissue web 75 and the other tissue webs. In one embodiment, the folding device provides each of the tissue webs with a primary fold 50 and additionally provides the first tissue web 75 with a secondary fold 60 (FIG. 2). The folding station 78 may function simply as an assembly station where the tissues are non-interfolded, as discussed previously.

The interfolded assemblage 80 may then be transported via the transport system 76 to an optional marrying station 81. The marrying station 81 may be employed to integrate the interfolded assemblage 80 with other interfolded assemblages (not shown) to form a final assemblage having the desired number of tissue webs. The marrying station 81 could alternatively be located later in the process or not be employed.

The transport system 76 next conveys the interfolded assemblage 80 to a location where a visual indicator 70 can be provided. A printing device 82 which is adapted to print a visual indicator 70 on the first tissue web 75 represents one means of providing a visual indicator 70. Preferably, only the first tissue 75 contains a visual indicator. The visual indicator can be a printed line, bar, symbol or design. Alternatively, the visual indicator 70 can be a tissue of a different color or a tissue having a contrast in color from subsequent tissues. When a different color tissue or a tissue having a contrast in color from subsequent tissues is used, there is no need for the printing device 82.

Figure 7:
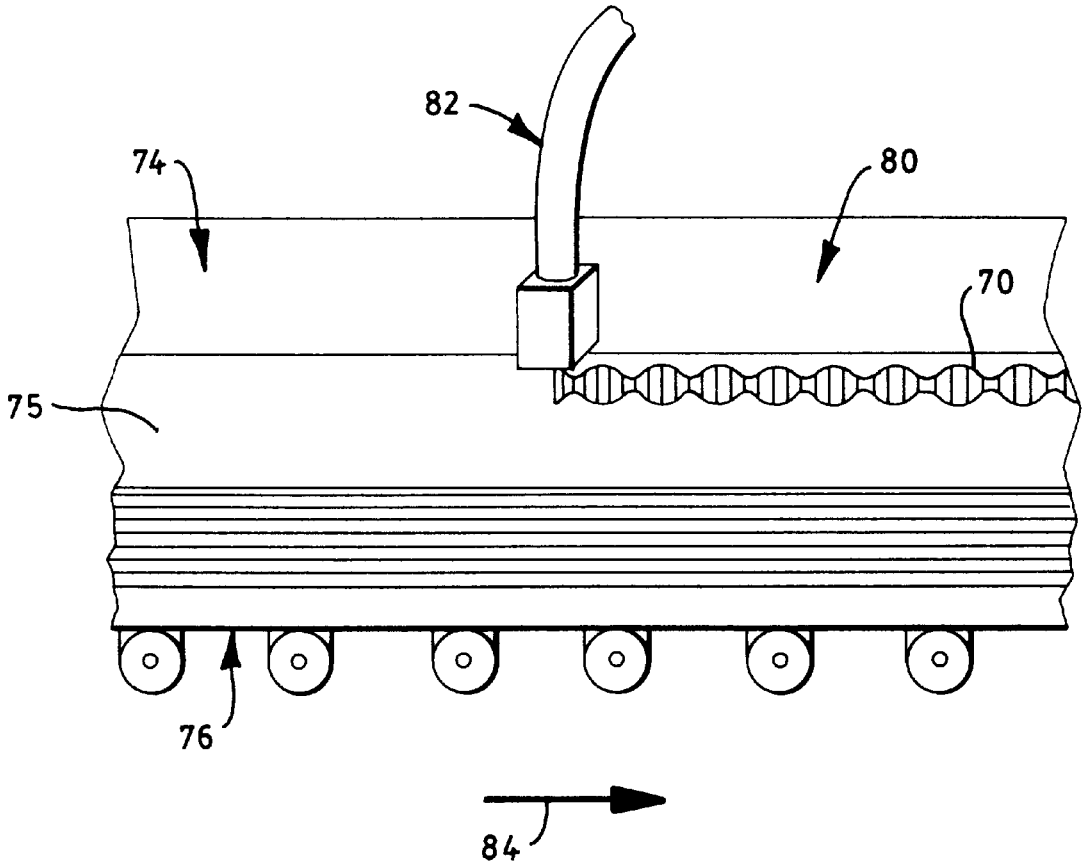
FIG. 7 representatively shows an enlarged perspective view of a printing device shown in block form in FIG. 6, the printing device functioning to print a visual indicator on a first tissue web of an in-process interfolded assemblage of multiple tissue webs.

FIG. 7 representatively shows operation of the printing device 82 as the interfolded assemblage 80 passes beneath the printing device in the direction of arrow 84. One suitable printing device 82 is an ink jet printer available from Videojet Systems International, Inc. of Wood Dale, Ill. The printing device 82 may be located within the manufacturing process so that the visual indicator 70 is printed on the first tissue web 75 after formation of the interfolded assemblage 80. Alternatively, the printing device 82 may be located prior to the folding station 78, such as the alternative location, designated reference numeral 86 in FIG. 6, whereby the visual indicator 70 would be printed on the first tissue web 75 before formation of the interfolded assemblage 80.

The complete assemblage is then transported to a cutting device 92. The cutting device 92 is adapted to cut the interfolded assemblage 80 into a plurality of clips 24 of prefolded interfolded tissues. The cut first tissue web 75 will form the visually distinctive tissue 40 of the clip 24 and will include the visual indicator 70. The individual clips 24 are taken by the transport system 76 to a packaging system 94 that is adapted to fold the clips 24 if necessary and place each of the clips 24 in a carton 22. The clips 24 and the visually distinctive tissue 40 are oriented within the carton 22 such that the visual indicator 70 is visible through the carton opening 34. The process and apparatus may be modified of course to change the location of the visually distinctive tissue 40 to other than the first tissue in the clip 24.

Figure 8:
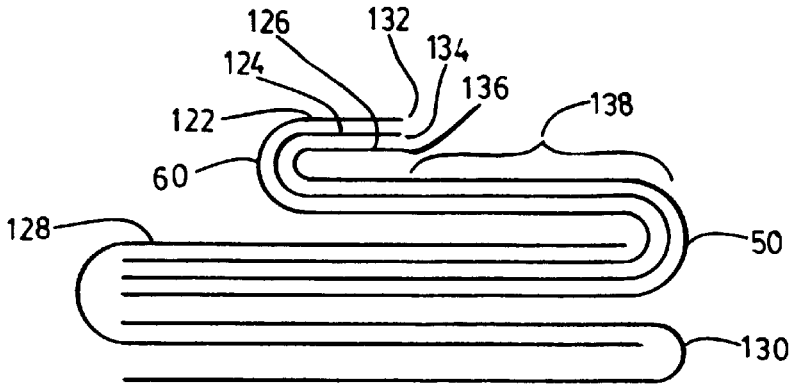
FIG. 8 is a side view of interfolded tissues forming a clip wherein three first sheets of tissue are folded together to form an "outward fold".
Figure 9:
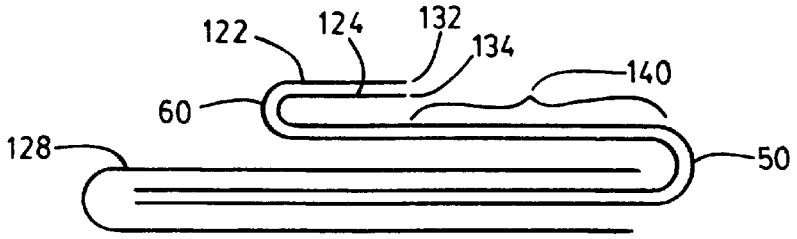
FIG. 9 is a side view of interfolded tissues forming a clip wherein two first sheets of tissue are folded together to form an "outward fold".

Referring to FIGS. 8 and 9, two different folding configurations are depicted. In FIG. 8, three first sheets of tissue 122, 124 and 126 are shown aligned vertically above one another. The three first sheets of tissue 122, 124 and 126 are identical in size and shape. The three first sheets of tissues 122, 124 and 126 are folded together and possess a primary fold 50 and a secondary fold 60. The three first sheets of tissues 122, 124 and 126 are interfolded with a fourth underlying tissue 128 which in turn is interfolded with a fifth underlying tissue 130. Additional interfolded tissues (not shown) will be present to complete the clip 24.

It should be noted that in FIG. 8 the three first sheets of tissues 122, 124 and 126 are folded together with an "outward fold" on top. In an "outward fold" the free ends 132, 134 and 136 of the three first sheets of tissue, 122, 124 and 126 respectively, are located above the remaining portions of the three first sheets of tissue 122, 124 and 126. The first sheet of tissue 122 and its free end 132 will be oriented toward the carton opening 34 and will be visible to the consumer. The second first sheet of tissue 124 will be hidden by the first sheet of tissue 122 but a region or portion 138 of the third first sheet of tissue 126 does face upward and may be visually seen through the carton opening 34. Alternatively, the free ends 132, 134 and 136 can be located conterminuous with the fold 50 such that the region or portion 138 is visually hidden.

It should be noted that some manufactures use either a single first sheet of tissue 122, two first sheets of tissues 122 and 124, or three first sheet of tissue 122, 124 and 126 at the top of each clip 24. The use of one, two or three first sheets of tissues 122, 124 or 126 is totally at the discretion of the tissue manufacturer. The reason for using more than one first sheet of tissue is that the weight of the second and/or third first sheets of tissue decreases the possibility of "fly back". "Fly back" is a phenomenon that can occur after the clip 24 is cut and is transported to an assembly station for insertion into a carton 22. The light weight of the first sheet of tissue 122 may allow it to flutter during transport. By employing two or more first sheets of tissue 122, 124 and 126, this problem is minimized or eliminated. The presence of two or more first sheets of tissues 122, 124 and 126 at the top of the interfolded clip 24 also assures that the initial first tissue(s) 122, 124 and 126 can be withdrawn without breaking apart or tearing as they are removed from the carton 22. Because of the initial size of the clip 24, the first sheet(s) are more likely to break or tear then are subsequent tissues.

The three first sheets of tissues 122, 124 and 126 are aligned to have one or more conterminuous edges, that is, one or more similar boundaries. Because of this, it is only necessary to print or apply a visual indicator 70 on only one of the three first tissues 122, 124 or 126. For example, the visual indicator can be printed or applied to either the first sheet of tissue 122 or to the third first sheet of tissue 126. The second first sheet of tissue 124 is sandwiched between the first and third sheets of tissue, 122 and 126 respectively, and therefore is not visually present to the user.

However, referring to FIG. 9, an embodiment is depicted wherein only two sheets of tissue 122 and 124 are used. If only two first sheets of tissue 122 and 124 are employed, then either first sheet 122 or 124 can have a visual indicator 70 printed or applied thereto for it will be exposed through the carton opening 34. The reason for this is that the second first sheet of tissue 124 has a region or portion 140 which faces upward toward the carton opening 34. Alternatively, the free ends 132 and 134 can be located conterminuous with the fold 50 such that the region or portion 140 is visually hidden.

The visual indicator 70 can be printed or applied at a location such that it is visible through the carton opening 34. If the visual indicator 70 consists of a different color tissue or a contrast in color between one of the first tissues 122, 124 or 126 and the remaining underlying tissues 128, 130 132, etc. then it is only necessary that one of the first three tissues 122, 124 or 126 be of that color, or exhibit the contrast in color from the remaining tissues.

Figure 10:
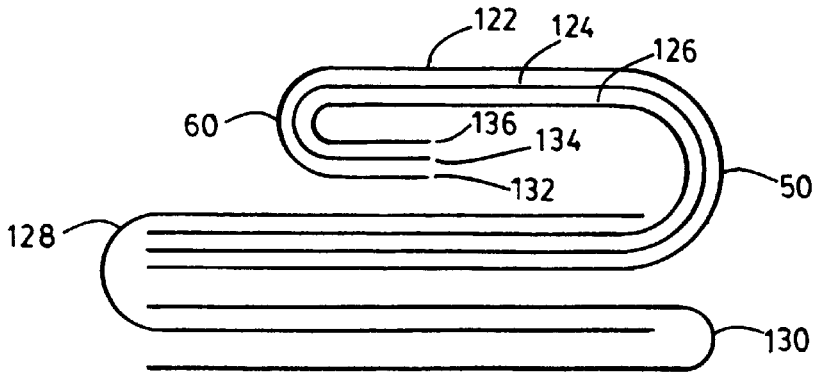
FIG. 10 is a side view of interfolded tissues forming a clip wherein three first sheets of tissue are folded together to form an "inward fold".

Lastly, referring to FIG. 10, still another embodiment is shown wherein three first sheets of tissue 122, 124 and 126 are utilized. FIG. 10 is similar to FIG. 8 except that the free ends 132, 134 and 136 are tucked under to form an "inward fold". In the "inward fold" only the first sheet of tissue 122 is exposed through the carton opening 34. Therefore, it only makes sense to print or apply a visual indicator 70 to the first sheet of tissue 122.

The foregoing detailed description has been for the purpose of illustration. Thus, a number of modifications and changes may be made without departing from the spirit and scope of the present invention. For instance, alternative or optional features described as part of one embodiment can be used to yield another embodiment. Additionally, two named components could represent portions of the same structure. Therefore, the invention should not be limited by the specific embodiments described but only by the claims.

I claim:

1. A method of packaging tissues in a pop-up dispenser, said pop-up dispenser being a carton having a top wall, a bottom wall and four sidewalls joining said top wall to said bottom wall, and having an opening formed in said top wall through which said tissues can be withdrawn, said method comprising the steps of:

a) providing several tissues that are substantially identical to one another, said several tissues including a first tissue and a plurality of other tissues;

b) transporting said several tissues to a folding station;

c) interfolding said several tissues at said folding station to form an interfolded assemblage of said first tissue and said other tissues;

d) providing a visual indicator on only said first tissue to form a visually distinctive tissue;

e) cutting said interfolded assemblage to form a plurality of clips of interfolded tissues, each of said clips including one of said visually distinctive tissues and a plurality of said other tissue; and f) placing each of said dips in a carton and orienting said visually distinctive tissue such that said visual indicator is visible through said carton opening.

2. The method of claim 1 wherein said several tissues that are substantially identical to one another include up to three first sheets of tissues and a plurality of other tissues, and at least one of said three first sheets of tissues is visual distinctive from said plurality of other tissues and is visible through said carton opening.

3. The method of claim 1 wherein said several tissues that are substantially identical to one another include up to three first sheets of tissues and a plurality of other tissues, and at least one of said three first sheets of tissues has a visual indicator which is visible through said carton opening.

4. The method of claim 1 wherein said first tissue has a different color than said plurality of other tissues.

5. The method of claim 1 wherein said first tissue has a contrast in color from said plurality of other tissues.

6. The method of claim 1 wherein said first tissue has a visual indicator printed thereon.

7. A method of packaging tissues in a pop-up dispenser, said pop-up dispenser being a carton having a top wall, a bottom wall and four sidewalls joining said top wall to said bottom wall, and having an opening formed in said top wall through which said tissues can be withdrawn, said method comprising the steps of:

a) providing several tissues that are substantially identical to one another, said several tissues including a first tissue and a plurality of other tissues;

b) providing a visual indicator on only said first tissue to form a visually distinctive tissue;

c) transporting said first tissue and said plurality of other tissues to a folding station;

d) interfolding said first tissue and said plurality of other tissues at said folding station to form an interfolded assemblage;

e) cutting said interfolded assemblage to form a plurality of clips of interfolded tissues, each of said clips including one of said visually distinctive tissues and a plurality of said other tissue; and f) placing each of said clips in a carton and orienting said visually distinctive tissue such that said visual indicator is visible through said carton opening.

8. The method of claim 7 wherein said first tissue has a contrast in color from an adjacent tissue.

9. The method of claim 7 wherein said first tissue has a contrast in color from a tissue located away from said first tissue.

10. The method of claim 7 wherein said first tissue has a visual indicator printed thereon.

11. The method of claim 7 wherein said several tissues that are substantially identical to one another include up to three first sheets of tissues and a plurality of other tissues, and at least one of said three first sheets of tissues is visual distinctive from said plurality of other tissues and is visible through said carton opening.

12. A method of packaging tissues in a pop-up dispenser, said pop-up dispenser being a carton having a top wall, a bottom wall and four sidewalls joining said top wall to said bottom wall, and having an opening formed in said top wall through which said tissues can be withdrawn, said method comprising the steps of:

a) providing several dry tissues that are substantially identical to one another, said several tissues including a first tissue and a plurality of other tissues;

b) transporting said several dry tissues to a folding station;

c) interfolding said several dry tissues at said folding station to form an interfolded assemblage of said first tissue and said other tissues, said first tissue and said plurality of other tissues each having a primary fold and said first tissue also having a secondary fold;

d) printing a visual indicator on only said first tissue to form a visually distinctive tissue, said visual indicator being located less than about 2 centimeters from said secondary fold;

e) cutting said interfolded assemblage to form a plurality of clips of interfolded tissues, each of said clips including one of said visually distinctive tissue and a plurality of said other tissues; and f) placing each of said dips in a carton and orienting said visually distinctive tissue such that said visual indicator is visible through said carton opening.

13. The method of claim 12 wherein said several tissues that are substantially identical to one another include up to three first sheets of tissues and a plurality of other tissues, and at least one of said three first sheets of tissues has a visual indicator printed thereon which is visible through said carton opening.

14. The method of claim 12 wherein said visual indicator is located less than about 1 centimeter from said secondary fold.

15. An apparatus for packaging tissues in a pop-up dispenser, said pop-up dispenser being a carton having a top wall, a bottom wall and four sidewalls joining said top wall to said bottom wall, and having an opening formed in said top wall through which said tissues can be withdrawn, said apparatus comprising:

a) a supply system adapted to provide several tissues that are substantially identical to one another, said several tissues including a first tissue and a plurality of other tissues;

b) a transport system adapted to transport said several tissues to a folding station;

c) a folding device located at said folding station and adapted to interfold said first tissue and said plurality of other tissues to form an interfolded assemblage;

d) means for providing a visual indicator on only said first tissue;

e) a cutting device adapted to cut said interfolded assemblage into a plurality of clips of interfolded tissues, each of said clips including a visually distinctive tissue and said plurality of other tissues; and f) a packaging system adapted to place each of said clips in a carton, said visually distinctive tissue being oriented within said carton such that said visual indicator is visible through said carton opening.

16. The apparatus of claim 15 wherein said means for providing a visual indicator is a printing device.

17. The apparatus of claim 16 wherein said several tissues that are substantially identical to one another include up to three first sheets of tissues and a plurality of other tissues, and at least one of said three first sheets of tissues has a visual indicator printed thereon which is visible through said carton opening.

18. The apparatus of claim 17 wherein said first tissue and said plurality of other tissues each have a primary fold and said first tissue also has a secondary fold, and said visual indicator is located less than about 2 centimeter from said secondary fold.

19. The apparatus of claim 18 wherein said visual indicator is located less than about 1 centimeter from said secondary fold.

20. An apparatus for packaging tissues in a pop-up dispenser, said pop-up dispenser being a carton having a top wall, a bottom wall and four sidewalls joining said top wall to said bottom wall, and having an opening formed in said top wall through which said tissues can be withdrawn, said apparatus comprising:

a) a supply system adapted to provide several tissues that are substantially identical to one another, said several tissues including a first tissue and a plurality of other tissues;

b) means for providing a visual indicator on only said first tissue;

c) a transport system adapted to transport said first tissue and said plurality of other tissues to a folding station;

d) a folding device located at said folding station and adapted to interfold said first tissue and said plurality of other tissues to form an interfolded assemblage;

e) a cutting device adapted to cut said interfolded assemblage into a plurality of clips of interfolded tissues, each of said dips including one of said visually distinctive tissues and said plurality of other tissues; and f) a packaging system adapted to place each of said clips in a carton, said visually distinctive tissue being oriented within said carton such that said visual indicator is visible through said carton opening.

21. The apparatus of claim 20 wherein said means for providing a visual indicator is a printing device.

22. The apparatus of claim 21 wherein said first tissue and said plurality of other tissues each have a primary fold and said first tissue also has a secondary fold, and said visual indicator is located less than about 2 centimeter from said secondary fold.

23. The apparatus of claim 22 wherein said visual indicator is located less than about 1 centimeter from said secondary fold.

24. An apparatus for packaging tissues in a pop-up dispenser, said pop-up dispenser being a carton having a top wall, a bottom wall and four sidewalls joining said top wall to said bottom wall, and having an opening formed in said top wall through which said tissues can be withdrawn, said apparatus comprising:

a) a supply system adapted to provide several tissues that are substantially identical to one another, said several tissues including a first tissue and a plurality of other tissues;

b) a transport system adapted to transport said several tissues to a folding station;

c) a folding device located at said folding station and adapted to interfold said first tissue and said plurality of other tissues to form an interfolded assemblage, said first tissue and said plurality of other tissues each having a primary fold and said first tissue also having a secondary fold;

d) a printing device adapted to print a visual indicator on only said first tissue, said visual indicator being located less than about 2 centimeters from said secondary fold;

e) a cutting device adapted to cut said interfolded assemblage into a plurality of clips of interfolded tissues, each of said clips including a visually distinctive tissue and said plurality of other tissues; and f) a packaging system adapted to place each of said clips in a carton, said visually distinctive tissue being oriented within said carton such that said visual indicator is visible through said carton opening.

* * * * *

UNITED STATES PATENT AND TRADEMARK OFFICE

CERTIFICATE OF CORRECTION

PATENT NO. : 6,182,418 B1
DATED : February 6, 2001
INVENTOR(S) : Timothy Maurice McFarland It is certified that error appears in the above-identified patent and that said Letters Patent is hereby corrected as shown below:

Column 2,
Line 38, delete “tom” and substitute -- torn --.

Column 8,
Line 22, delete “Its” and substitute -- its --.

Column 11,
Line 24, delete “dips” and substitute -- clips --.

Column 13,
Line 44, delete “dips” and substitute -- clips --.

Signed and Sealed this

Twenty-eighth Day of January, 2003

JAMES E. ROGAN
*Director of the United States Patent and Trademark Office*